US007585445B2

(12) United States Patent
Tiemeier et al.

(10) Patent No.: US 7,585,445 B2
(45) Date of Patent: Sep. 8, 2009

(54) METHOD FOR PRODUCING HIGH TENACITY POLYPROPYLENE FIBERS

(75) Inventors: Hendrik Tiemeier, Neumünster (DE); Horst Kropat, Neumünster (DE)

(73) Assignee: Saurer GmbH & Co., KG, Monchengladbach (DE)

( * ) Notice: Subject to any disclaimer, the term of this patent is extended or adjusted under 35 U.S.C. 154(b) by 786 days.

(21) Appl. No.: 11/070,557

(22) Filed: Mar. 2, 2005

(65) Prior Publication Data

US 2005/0146071 A1 Jul. 7, 2005

Related U.S. Application Data

(63) Continuation of application No. PCT/EP03/10453, filed on Sep. 19, 2003.

(30) Foreign Application Priority Data

Sep. 26, 2002 (DE) ..... 102 44 830

(51) Int. Cl.
*D01D 5/088* (2006.01)
*D01D 5/16* (2006.01)
*D02J 1/22* (2006.01)

(52) U.S. Cl. ..... 264/210.7; 264/210.8; 264/290.5

(58) Field of Classification Search ..... 264/210.7, 264/210.8, 290.5; 425/66
See application file for complete search history.

(56) References Cited

U.S. PATENT DOCUMENTS 4,347,206 A * 8/1982 Roberts ..... 264/211.15
4,504,432 A * 3/1985 Kamei et al. ..... 264/177.13
5,609,888 A * 3/1997 Uda et al. ..... 425/66
5,629,080 A * 5/1997 Gupta et al. ..... 428/373
5,846,654 A 12/1998 Modrak
6,210,622 B1 * 4/2001 Reese et al. ..... 264/479
6,218,011 B1 * 4/2001 Raetzsch et al. ..... 428/394

FOREIGN PATENT DOCUMENTS

DE 3539185 A1 * 6/1986
DE 198 60 335 A1 7/1999
EP 0 535 373 A1 4/1993
WO WO 2004/007817 A1 1/2004

OTHER PUBLICATIONS

*Continuous Spin-Draw-Texturizing,* R. Wiedermann, International Fiber Journal, 6160, No. 5, Oct. 1991, pp. 43-48.

* cited by examiner

*Primary Examiner*—Richard Crispino
*Assistant Examiner*—Michael A Tolin
(74) *Attorney, Agent, or Firm*—Alston & Bird LLP

(57) ABSTRACT

A method for producing high-tenacity polypropylene fibers with a tenacity greater than 6 cN/dtex and an elongation of less than 40%. To produce as much as possible fibers of a very fine denier, the fiber strands are spun in a first step at a low melting point of less than 250° C., and are withdrawn at a relatively low withdrawal speed of less than 100 m/min., while being simultaneously cooled by a gaseous cooling medium. Subsequently, the fiber strands undergo drawing in at least three draw zones with a total draw ratio greater than 4:1. In this process, the fiber strands are partially drawn in the first draw zone to at least 70% of the total draw. After having been drawn, the fiber strands are cut to a predetermined fiber length.

12 Claims, 2 Drawing Sheets

METHOD FOR PRODUCING HIGH TENACITY POLYPROPYLENE FIBERS

CROSS REFERENCE TO RELATED APPLICATION

The present application is a continuation of international application PCT/EP2003/010453, filed 19 Sep. 2003, and which designates the U.S. The disclosure of the referenced application is incorporated herein by reference.

BACKGROUND OF THE INVENTION

The invention relates to a method for producing polypropylene fibers having high tenacity and low elongation, by continuously melt spinning, withdrawing, drawing, and cutting polypropylene fiber strands.

A single zone method of this type for producing high tenacity polypropylene fibers is known from DE 35 39 185.

In the known method, fiber strands advance after spinning into a water bath for the purposes of undergoing cooling. Subsequently, they undergo drawing in a draw zone at a high draw ratio of up to 10:1. As a result of cooling the fiber strands in the water bath relatively quickly, a relatively high partial orientation occurs in the surface region of the individual fibers with the consequence of a poor stretch capability. In addition, the known method is suitable only for producing relatively coarse fibers with an individual denier in a range greater than 3 dtex. The greater friction effect on the individual filaments alone, which is caused by the water bath, does not permit spinning fibers with finer deniers.

However, right along with the use of such fibers for reinforcing concrete, there is a desire for very high-tensile and fine fibers. DE 198 60 335 A1 discloses a polypropylene fiber, wherein the disadvantage of a rapid quench in a liquid was replaced with air cooling. While this measure permitted producing fiber strands with finer individual deniers, it had the disadvantage that the fibers exhibited a high elongation of more than 60%. However, it has been found in the reinforcement of concrete base bodies that the elongation values of the reinforcement fibers should approximately correspond to those of the base material that is to be reinforced, so that the fibers are able to absorb the load at the earliest possible time, and that the base body remains unaffected. Thus, fibers with relatively high elongation values are suited only to a limited extent.

EP 0 535 373 A1 discloses a polypropylene fiber, which has a required fine denier with a high tenacity, but which can be produced only in a costly, two-zone process. In this process, the fiber is temporarily stored after spinning and drawing, while receiving an additional treatment by impregnation. Subsequently, in a second stage, the fiber strands are again taken up, dried, and cut.

It is therefore an object of the invention to provide a method for producing high tenacity polypropylene fibers of the initially described type, which permits producing particularly fine fibers with an individual denier of less than 2 dtex.

A further object of the invention is to provide an apparatus for carrying out the method.

SUMMARY OF THE INVENTION

The above and other objects and advantages of the invention are achieved by the provision of a melt spinning method and apparatus wherein a polypropylene melt is extruded at a relatively low melting temperature and withdrawn and cooled at a relatively low withdrawal speed. Thereafter, the strands are passed through at least three draw zones, with a total draw ratio which is greater than about 4:1. In the first draw zone, a partial drawing of at least about 70% of the total draw is achieved. The drawn fibers are then cut to produce staple fibers.

The invention distinguishes itself in that on the one hand the low melting point during the spinning in combination with a slow withdrawal speed assists a partial molecule orientation of the undrawn fibers, and consequently results in a higher tenacity of the fibers. Because of the slow withdrawal speed, clearly lesser internal tensions occur between the polymer chains in the filaments during the cooling process after spinning. A subsequent drawing in three successive draw zones, while taking into account that already in a first draw zone the fiber undergoes 70% of the total drawing, permits producing a constant slow polymer crystallization in the fibers, so that besides the high tenacity, a low residual elongation and a corresponding fineness result in the fibers.

To increase the favorable properties of the fibers, the partial drawing of the fiber strands in the second draw zone is performed at a higher ratio than in the following third draw zone. Thus, the total drawing in the draw zones proceeds at a respectively decreasing draw ratio.

To obtain after spinning in the first draw zone a partial drawing that is as defined as possible, the fiber strands are withdrawn after melt spinning by a first draw system with a plurality of draw rolls whose outer surfaces are cooled. Subsequently, the fiber strands advance within the first draw zone through a heated draw channel, and are heated for undergoing drawing to a temperature above 100° C.

To make a transition in the draw zones as continuous as possible, the fiber strands are continuously tempered after the first draw zone until they enter the third draw zone to a temperature>100° C. by advancing over a plurality of heated draw rolls. To this end, the draw rolls of the draw systems forming the second draw zone are preferably made heatable.

In addition, it is possible to perform within the second draw zone a further heat treatment of the fiber strands by means of a further heated draw channel. Inside the heated draw channels, the fiber strands can be heated by hot air or hot vapor. It has been found especially advantageous to temper the fiber strands in the first draw zone with hot air and in the second draw zone with hot vapor.

After having been drawn, the fiber strands are cooled, preferably by advancing over a plurality of cooled draw roll of a fourth draw system at the end of the third draw zone.

A further variant of the method consists of crimping the fiber strands after having been drawn and before being cut.

To obtain as much as possible high capacities of more than 10 t per day, it is preferred to extrude the fiber strands through an annular or rectangular spinneret with as many as about 60,000 to 120,000 spin holes.

The apparatus of the invention for carrying out the method of the invention is characterized in that the draw zones are configured and distributed such that they permit producing polypropylene fibers having a high tenacity of more than 6 cN/dtex with a low elongation of less than 40%, preferably less than 20% and a corresponding fineness in the individual deniers. The draw rolls of the intermediate draw systems are preferably made heatable to ensure a uniform and continuous tempering of the fiber strands while being drawn. The draw systems at the inlet and the outlet of the entire draw zone are preferably constructed with cooled draw rolls.

BRIEF DESCRIPTION OF THE DRAWINGS

In the following, the method of the invention is described in greater detail by means of an embodiment of an apparatus according to the invention with reference to the attached drawings, in which.

DETAILED DESCRIPTION OF THE PREFERRED EMBODIMENTS

Figure 1:
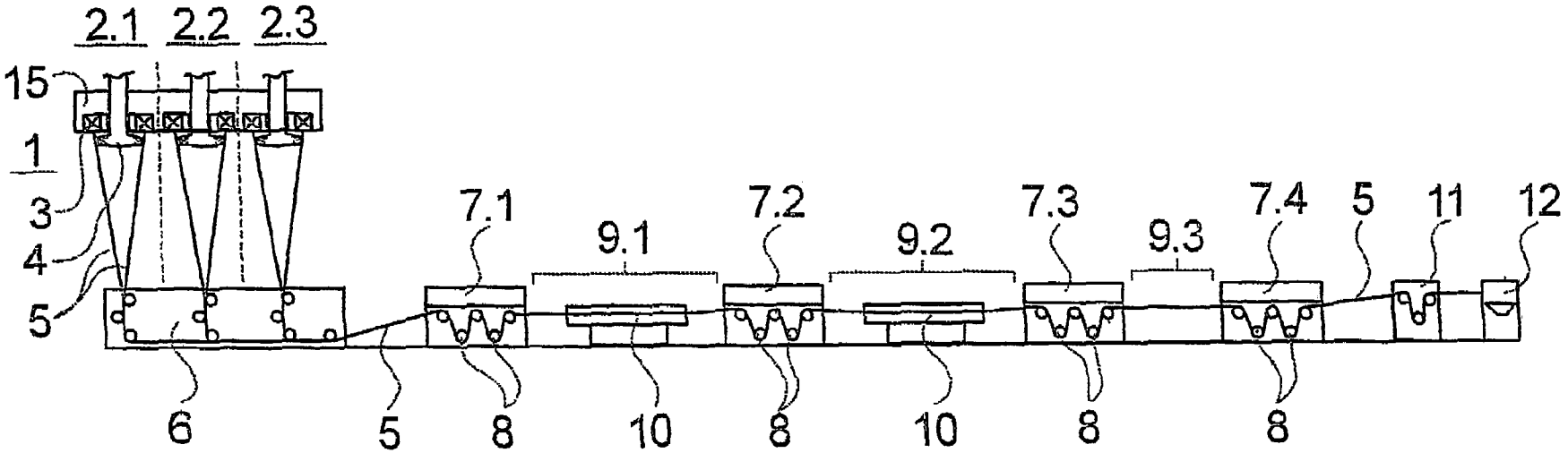
FIG. 1 is a schematic view of a first embodiment of an apparatus according to the invention for carrying out the method of the invention.

FIG. 1 schematically illustrates a first embodiment of an apparatus according to the invention for a single zone production of polypropylene fibers. Apparatus of this type are generally known to experts as compact spin lines for producing staple fibers, preferably of polypropylene. The compact spin lines are operated at spinning speeds in the range of maximally 250 m/min. With that, it is possible to reach very high production capacities of as much as 50 t per day.

The apparatus of the invention corresponds to such compact spin lines, and comprises to this end a spinning device 1 with a plurality of spinning positions 2.1-2.3 arranged in side-by-side relationship. The number of the spinning positions in the embodiment shown in FIG. 1 is exemplary. Each of the spinning positions 2.1-2.3 is constructed to be identical, so that they all may be described in greater detail with reference to spinning position 2.1.

To extrude a plurality of fiber strands, it is preferred to provide an annular spinneret 3 that has on its underside a plurality of spin holes. For example, it is possible to arrange in the spinneret 3 as many as 120,000 spin holes in an annular or rectangular arrangement. The spinneret 3 connects to a melt source (not shown), which supplies a melt flow under pressure to the spinneret 3. Suitable melt sources for supplying a melt flow to the spinneret 3 are basically extruders, pumps, or combinations of both.

The spinnerets 3 of the spinning positions 2.1-2.3 are arranged in a heated spin beam 15. Downstream of the spin beam 15, the spinning position comprises a cooling device 4 arranged in substantially concentric relationship with the spinneret 3. The cooling device 4 is constructed as an air quench system, wherein a cooling air flow is generated by an annular blow nozzle, so that cooling air flows from the inside outward through an annular sheet formed by the fiber strands, and leads to a cooling thereof. In the illustrated embodiment, the cooling air of the cooling device 4 is supplied from the top through the spin beam 15. However, it is also possible to position the cooling air supply laterally adjacent to the emerging fiber strands.

To advance and treat the fiber strands which are identified in the embodiment of FIG. 1 by the numeral 5, a plurality of treatment devices are arranged downstream of the spinning device 1. As a first treatment device, a withdrawal device 6 is directly associated with the spinning device 1. For each spinning position, the withdrawal device 6 comprises means for lubricating and advancing the fiber strands 5. For example, in the case of lubrication, a lubricant can be applied to the fiber strands by rolls. The withdrawal device 6 is arranged downstream of the spinning device 1. It is used to deflect the fiber strands 5 of the spinning positions 2.1-2.3 from a vertical path and to combine them. In this process, the plurality of fiber strands 5 which are also named tows, are withdrawn by a first draw system 7.1. The draw system 7.1 is arranged directly adjacent to the withdrawal device 6.

The draw system 7.1 is followed by a total of three additional draw systems 7.2-7.4. The draw systems 7.1, 7.2, 7.3, and 7.4 form between themselves respectively one draw zone. Thus, a first draw zone 9.1 is formed between the first draw system 7.1 and the second draw system 7.2. A second draw zone 9.2 is formed between the draw systems 7.2 and 7.3, and a third draw zone 9.3 between the draw systems 7.3 and 7.4. Each of the draw systems 7.1-7.4 includes a plurality of draw rolls 8, over which the fiber strands 5 advance with a single looping. The draw rolls 8 of the draw systems 7.1-7.4 are driven. Depending on the desired draw ratio, the draw rolls 8 of the draw systems 7.1-7.4 are operated at different circumferential speeds. For a simultaneous thermal treatment of the fiber strands, the draw rolls 8 of the draw systems 7.1-7.4 may have, depending on need, a cooled outer surface or a heated outer surface. Furthermore, for a thermal treatment of the fiber strands between the first draw system 7.1 and the second draw system 7.2, the first draw zone 9.1 accommodates a heated draw channel 10. Inside the heated draw channel 10, the fiber strands 5 can be tempered to a predetermined temperature by means of hot air or by means of hot vapor. Arranged in the second draw zone 9.2, likewise between the draw systems 7.2 and 7.3, is a further heated draw channel 10.

Provided at the end of the fiber line formed by the successively arranged draw system 7.1-7.4 are a tension adjusting device 11 as well as a cutting device 12 for continuously cutting the fiber strands to staple fibers of a predetermined fiber length.

For carrying out the method of the invention in an apparatus shown in FIG. 1, a polymer melt of polypropylene is extruded, in a first step, under pressure in the spinning device 1 via the spinnerets 3 of the spinning positions 2.1-2.3 to a plurality of fiber strands. The fiber strands 5 emerging from the spinnerets 3 are withdrawn therefrom via the withdrawal device 6 by the draw system 7.1 at a withdrawal speed below 100 m/min., preferably at a withdrawal speed below 50 m/min. In this process, the fiber strands 5 are cooled by means of the cooling device 4 with a misty or gaseous cooling medium flow, preferably air. Subsequently, upon leaving the withdrawal device 6, they are lubricated and combined to a tow that contains all fiber strands. The draw rolls 8 of the first draw system 7.1 are driven at the withdrawal speed. At the same time, the fiber strands undergo a further cooling on the circumference of the draw rolls 8 of the first draw system 7.1. To this end, the draw rolls 8 of the first draw system 7.1 are made with cooled outer surfaces.

The drawing of the fiber strands 5 occurs in a total of three draw zones 9.1-9.3, with a different draw ratio in each zone. The total draw ratio is greater than about 4:1. In the zones, the fiber strands are drawn with different intensity. To obtain a highly tensile, in particular fine fiber, the fiber strands undergo in the first draw zone 9.1 a partial drawing that amounts to at least 70% of the total drawing. For the drawing in the first draw zone 9.1, the fiber strands 5 are heated in the heated draw channel 10, preferably by hot air, to a temperature>100°.

Subsequently, the fiber strands advance over the draw rolls 8 of the second draw system 7.2, which are likewise heated to a temperature of more than 100° C. The second partial drawing of the fiber strands 5 occurs in the second draw zone 9.2, which likewise provides a treatment in a heated draw channel 10. The fiber strands undergo further partial drawing in the third draw system 7.3, with the partial drawing in the second draw zone 9.2 being higher than the final partial drawing in the third draw zone 9.3. The rolls 8 of the third draw system 7.3 are likewise heated to a surface temperature>100° C. to obtain a uniform continuous drawing. After the third partial drawing, the fiber strands 5 are cooled by the cooled draw rolls 8 of the fourth draw system 7.4. Subsequently, they are evenly cut to fibers of the predetermined fiber length.

With the use of a commercially available polypropylene polymer, it was possible to produce in a plurality of test series fibers with a fiber length of 6.6 mm, or alternatively 13 mm, which had an individual denier in the range from 0.9 to 1.6 dtex, a tenacity in the range from 8 to 9 cN/dtex, and an elongation ranging from 18 to 21%. During the spinning of the fiber strands, the melting point was set to a value≦250° C. The spin plate had an annular arrangement of spin holes amounting to several 10,000.

The rolls of the first draw system 7.1 operated at a withdrawal speed ranging from 25 to 40 m/min., the draw rolls of the second draw system 7.2 at a speed ranging from 80 to 115 m/min., the draw rolls of the third draw system 7.4 at a speed ranging from 100 to 140 m/min, and the draw rolls of the fourth draw system 7.4 at a speed from 110 to 160 m/min. The surface temperatures of the draw rolls 8 were in the case of the first draw system 7.1 about 30° C., in the case of the second draw system 7.2 >100° C., in the case of the third draw system 7.3 likewise >100° C., and in the case of the fourth draw system 7.4 about 30° C. In the first draw zone 9.1, the fiber strands were tempered in the heated draw channel 10 with hot air that had a temperature above 100° C. In the second draw zone 9.2, the fiber strands were treated with hot vapor at a temperature<100° C. The therewith obtained draw ratios for producing the referenced fibers ranged from 2.8 to 3.2:1 in the first draw zone 9.1, from 1.05 to 1.5:1 in the second draw zone 9.2, and from 1.05 to 1.3:1 in the third draw zone 9.3. In particular the high draw ratio in the first draw zone 9.1, and the subsequent drawing in the second draw zone 9.2 at a high temperature or at low temperatures in the third draw zone 9.3 cause in combination with the relatively low withdrawal speed the preferred slow and constant polymer crystallization in the fiber strands. This slow and constant crystallization results in that a high tenacity with little residual elongation is obtained. In this connection, the multizone drawing process permits producing a particularly fine fiber with individual deniers below 2 dtex.

Figure 2:
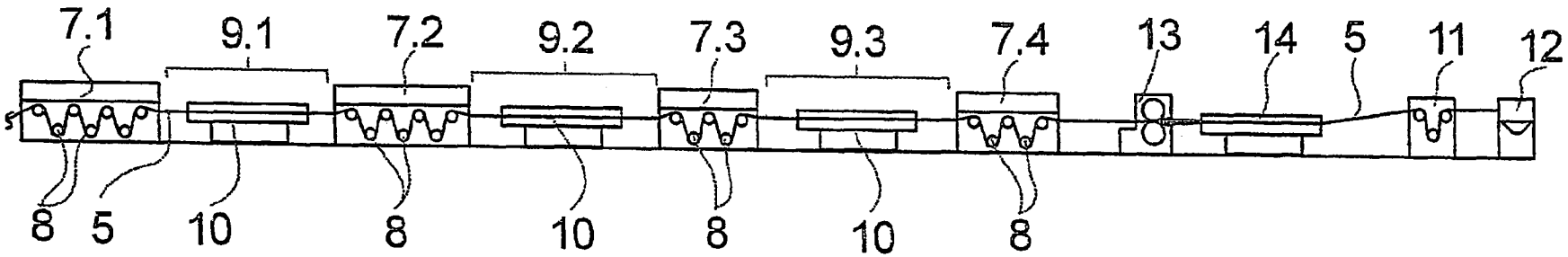
FIG. 2 is a schematic view of a further embodiment of the apparatus according to the invention.

FIG. 2 schematically illustrates a further embodiment of an apparatus according to the invention for carrying out the method of the invention. In the embodiment illustrated in FIG. 2, the spinning device 1 and the withdrawal device 6 are not shown. These are identical with the foregoing embodiment, so that the foregoing description is herewith incorporated by reference.

In the embodiment shown in FIG. 2, the successively arranged treatment devices for treating the fiber strands are formed by the draw systems 7.1-7.4, as well as a crimping device 13, a drying device 14, as well as the tension adjusting device 11, and the cutting device 12. The draw systems 7.1-7.4 are made substantially identical with the foregoing embodiment, only the number of the draw rolls 8 used in each draw system is different. To treat the fiber strands, each of the draw zones 9.1-9.3 is provided with a heated draw channel 10. The treatment of the fiber line in the heated draw channels 10 occurs in the first draw zone 9.1 and in the second draw zone 9.2 preferably with hot air, and in the third draw zone 9.3 with vapor. However, it is also possible to provide in each of the draw zones 9.1-9.3 a treatment of the fibers by a combination of a hot air treatment and a vapor treatment.

With the embodiment shown in FIG. 2, it is possible to produce a crimped polypropylene fiber that has a tenacity greater than 6 cN/dtex, an elongation of <40%, preferably <30%, and a fineness with an individual denier of <2 dtex. To this end, the fiber strands 5 are crimped after drawing by the crimping device 13. The crimping device 13 is typically constructed as a stuffer box crimping device, in which a conveying medium compresses the fiber strands into a stuffer box chamber. After crimping, the fiber strands advance to the drying device 14. Subsequently, the tension adjusting device 11 supplies the fiber strands under a defined tension to the cutting device 12. Normally, a tow combining device and a steaming channel (both not shown) are arranged upstream of the crimping device.

The construction of the embodiments of FIGS. 1 and 2 for the apparatus of the invention is exemplary with respect to the number and the selection of the treatment devices. Basically, there exists the possibility of introducing additional treatments and treatment zones, for example, by combining tows for adjusting a fiber feed that is suitable for crimping. It is likewise possible to provide more than three successive draw zones.

Important for the method and the apparatus of the invention is spinning at low melting points at simultaneously low withdrawal speeds in combination with drawing the fiber strands in at least three draw zones, while taking into account a high partial draw ratio in the first draw zone. Important for the success of the method according to the invention is, to begin with, a slightly partially oriented molecular structure of the fiber line after spinning and cooling to then obtain a uniform and constant crystallization. Basically, however, it is also possible to process with the apparatus of the invention other polymers, such as, for example, polyester or polyamide.

The invention claimed is:

1. A method for producing high-tenacity polypropylene fibers with an individual denier of less than 2 dtex having a tenacity above 6 cN/dtex and an elongation below 40%, comprising the steps of:

melt spinning a plurality of fiber strands comprising about 60,000 to 120,000 filaments from a polypropylene melt with a melting point≦250° C.;

withdrawing the fiber strands at a withdrawal speed<100 m/min., while simultaneously cooling the fiber strands with a gaseous cooling medium;

combining all fiber strands to a tow;

drawing the withdrawn fiber strands in at least three draw zones, with a partial drawing of the fiber strands occurring in each of the draw zones to achieve a total draw ratio greater than about 4:1, and with the fiber strands undergoing in the first draw zone a partial drawing of at least 70% of the total draw; and cutting the drawn fiber strands to produce polypropylene fibers of a predetermined fiber length.

2. The method of claim 1, wherein the partial drawing of the fiber strands is higher in the second draw zone than the partial drawing of the fiber strands in the third draw zone.

3. The method of claim 1, wherein after the melt spinning, the fiber strands are withdrawn by a first draw system having a plurality of draw rolls which each have a cooled outer surface.

4. The method of claim 1, wherein the fiber strands are advanced within the first draw zone through a heated draw channel and heated to a temperature>100° C.

5. The method of claim 4, wherein the fiber strands are tempered to a temperature>100° C. after the first draw zone and until they enter the third draw zone by advancing over a plurality of heated draw rolls.

6. The method of claim 5, wherein the heated draw rolls forming the second draw zone have surfaces that are heated to a temperature>100° C.

7. The method of claim 4, wherein within the second draw zone, the fiber strands advance through a heated draw channel and are heated therein.

8. The method of claim 7, wherein while advancing through the heated draw channels of the first and second draw zones, the fiber strands are heated by hot air and/or hot vapor.

9. The method of claim 1, wherein after the drawing step, the fiber strands are cooled in that the fiber strands advance over a plurality of cooled draw rolls.

10. The method of claim 1, wherein the fiber strands are crimped after having been drawn and before being cut.

11. The method of claim 1, wherein in the melt spinning step, the fiber strands are extruded through an annular spinneret having between about 60,000 to 120,000 spin holes.

12. The method of claim 1, wherein the plurality of fiber strands are brought together to form a tow during the withdrawing step, and wherein the tow is subjected to the drawing and cutting steps.

* * * * *

UNITED STATES PATENT AND TRADEMARK OFFICE

CERTIFICATE OF CORRECTION

PATENT NO. : 7,585,445 B2
APPLICATION NO. : 11/070557
DATED : September 8, 2009
INVENTOR(S) : Tiemeier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1063 days.

Signed and Sealed this

Fourteenth Day of September, 2010

David J. Kappos

David J. Kappos
*Director of the United States Patent and Trademark Office*